US007753648B2

(12) United States Patent
Evans et al.

(10) Patent No.: US 7,753,648 B2
(45) Date of Patent: Jul. 13, 2010

(54) GUIDE VANE ARRANGEMENTS FOR GAS TURBINE ENGINES

(75) Inventors: Dale E Evans, Derby (GB); Alison J McMillan, Uttoxeter (GB); Stephen J Booth, Derby (GB)

(73) Assignee: Rolls-Royce plc, London (GB)

( * ) Notice: Subject to any disclaimer, the term of this patent is extended or adjusted under 35 U.S.C. 154(b) by 733 days.

(21) Appl. No.: 11/645,511

(22) Filed: Dec. 27, 2006

(65) Prior Publication Data

US 2007/0183891 A1 Aug. 9, 2007

(30) Foreign Application Priority Data

Jan. 11, 2006 (GB) ..... 0600418.8

(51) Int. Cl.
*F03B 11/02* (2006.01)

(52) U.S. Cl. ..... 415/191; 415/208.1; 415/209.3; 415/209.4; 415/210.1; 415/200

(58) Field of Classification Search ..... 415/191, 415/208.1, 209.3, 209.4, 210.1, 200
See application file for complete search history.

(56) References Cited

U.S. PATENT DOCUMENTS 2,919,883 A * 1/1960 Murphy ..... 267/140.11
3,018,085 A * 1/1962 Welsh ..... 415/136
3,778,184 A * 12/1973 Wood ..... 415/209.4
4,305,696 A 12/1981 Pask
4,334,822 A * 6/1982 Rossmann ..... 415/113
4,384,822 A * 5/1983 Schweikl et al. ..... 415/137
4,655,682 A * 4/1987 Kunz et al. ..... 415/119
4,897,021 A 1/1990 Chaplin
5,192,185 A 3/1993 Leonard
5,306,118 A 4/1994 Holmes
5,482,433 A * 1/1996 Norris et al. ..... 415/173.7
6,619,917 B2 * 9/2003 Glover et al. ..... 415/209.3

FOREIGN PATENT DOCUMENTS

GB 2 076 069 A 11/1981

* cited by examiner

*Primary Examiner*—Igor Kershteyn
(74) *Attorney, Agent, or Firm*—Jeffrey S. Melcher; Manelli Denison & Selter PLLC

(57) ABSTRACT

A guide vane arrangement 20 for a gas turbine engine (10, FIG. 1) includes a vane member 21 extending between inner and outer platforms 22, 24 which are respectively mounted on inner and outer mounting members 42, 34. One of the inner and outer platforms 22, 24 includes a resilient that abuts the respective inner or outer platform 22, 24 to permit relative movement between the inner or outer platform 22, 24 and the respective inner or outer mounting member 42, 34.

18 Claims, 2 Drawing Sheets

GUIDE VANE ARRANGEMENTS FOR GAS TURBINE ENGINES

BACKGROUND OF THE INVENTION

The present invention relates to guide vane arrangements for gas turbine engines.

Guide vane arrangements are used in gas turbine engines to control airflow through the engine. Radial expansion of individual guide vane members can occur as a result of the flow of hot air or gases over the vane members, and this can induce stresses in the vane members when they are constrained to prevent radial movement.

It would therefore be desirable to provide an improved guide vane arrangement in which stresses resulting from thermal expansion can be reduced.

SUMMARY OF THE INVENTION

According to a first aspect of the present invention, there is provided a guide vane arrangement for a gas turbine engine, the guide vane arrangement including a vane member extending between inner and outer platforms, and inner and outer mounting members on which each of the inner and outer platforms is respectively mounted, one of the inner and outer mounting members including a resilient means for abutment with the respective inner or outer platform to permit relative movement between the inner or outer platform and the respective inner or outer mounting member.

The relative movement may be in a radial direction of the engine.

The inner platform may define upstream and downstream edges.

The inner platform may abut the resilient means. The inner platform may abut the resilient means at a position close to its downstream edge and may be rigidly mounted on the inner mounting member at its upstream edge.

The inner platform may abut the resilient means at a position close to its upstream edge and may be rigidly mounted on the inner mounting member at its downstream edge.

The inner platform may include inner platform mounting means for rigidly mounting it on the inner mounting member at its upstream or downstream edge.

The outer platform may be rigidly mounted on the outer mounting member at its upstream and downstream edges. The outer platform may include outer platform mounting means for rigidly mounting it on the outer mounting member at its upstream and downstream edges.

The outer platform may abut the resilient means.

The outer platform may abut the resilient means at a position close to its downstream edge and may be rigidly mounted on the outer mounting member at its upstream edge. The outer platform may abut the resilient means at a position close to its upstream edge and may be rigidly mounted on the outer mounting member at its downstream edge. The outer platform may include outer platform mounting means for rigidly mounting it on the outer mounting member at its upstream or downstream edge.

The inner platform may be rigidly mounted on the inner mounting member at its upstream and downstream edges. The inner platform may include inner platform mounting means for rigidly mounting it on the inner mounting member at its upstream and downstream edges.

The resilient means may comprise a viscoelastic material. The resilient means may comprise a rubber material.

The resilient means may comprise viscous fluid which may be contained within a flexible housing.

The vane member may comprise a composite material.

According to a second aspect of the present invention, there is provided a gas turbine engine including a guide vane arrangement according to the first aspect of the present invention.

BRIEF DESCRIPTION OF THE DRAWINGS

An embodiment of the present invention will now be described by way of example only, and with reference to the accompanying drawings, in which.

DETAILED DESCRIPTION OF THE INVENTION

Figure 1:
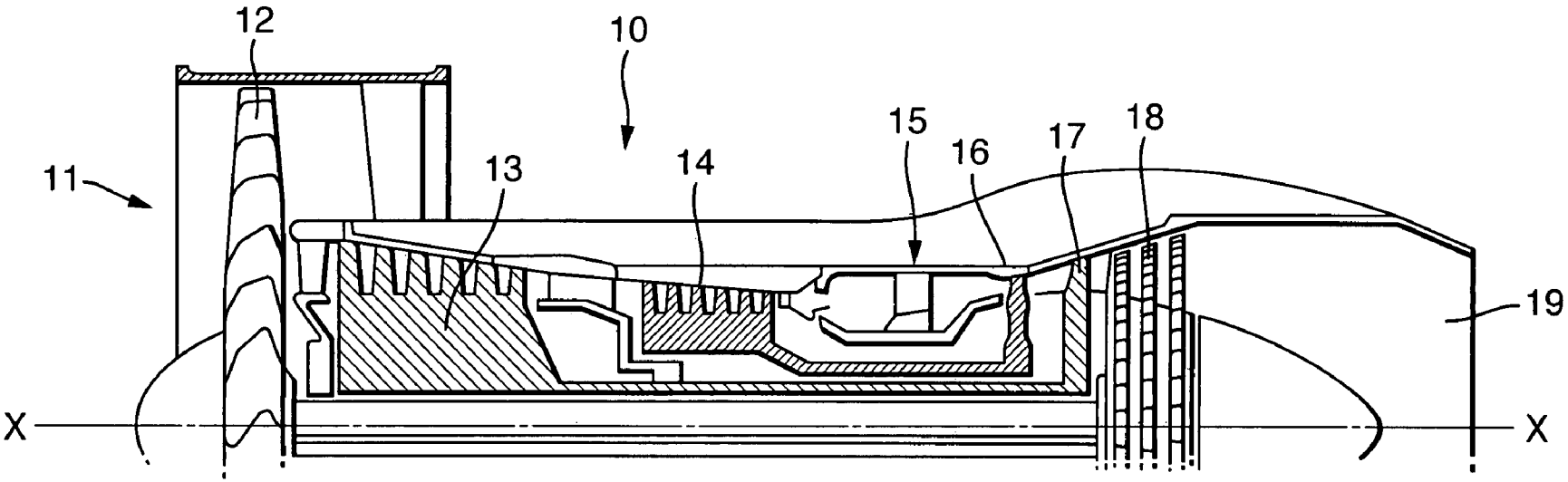
FIG. 1 is a cross-sectional view of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

In order to control airflow through the engine 10, the engine 10 includes a guide vane arrangement 20 comprising a plurality of circumferentially spaced vane members 21.

Figure 2:
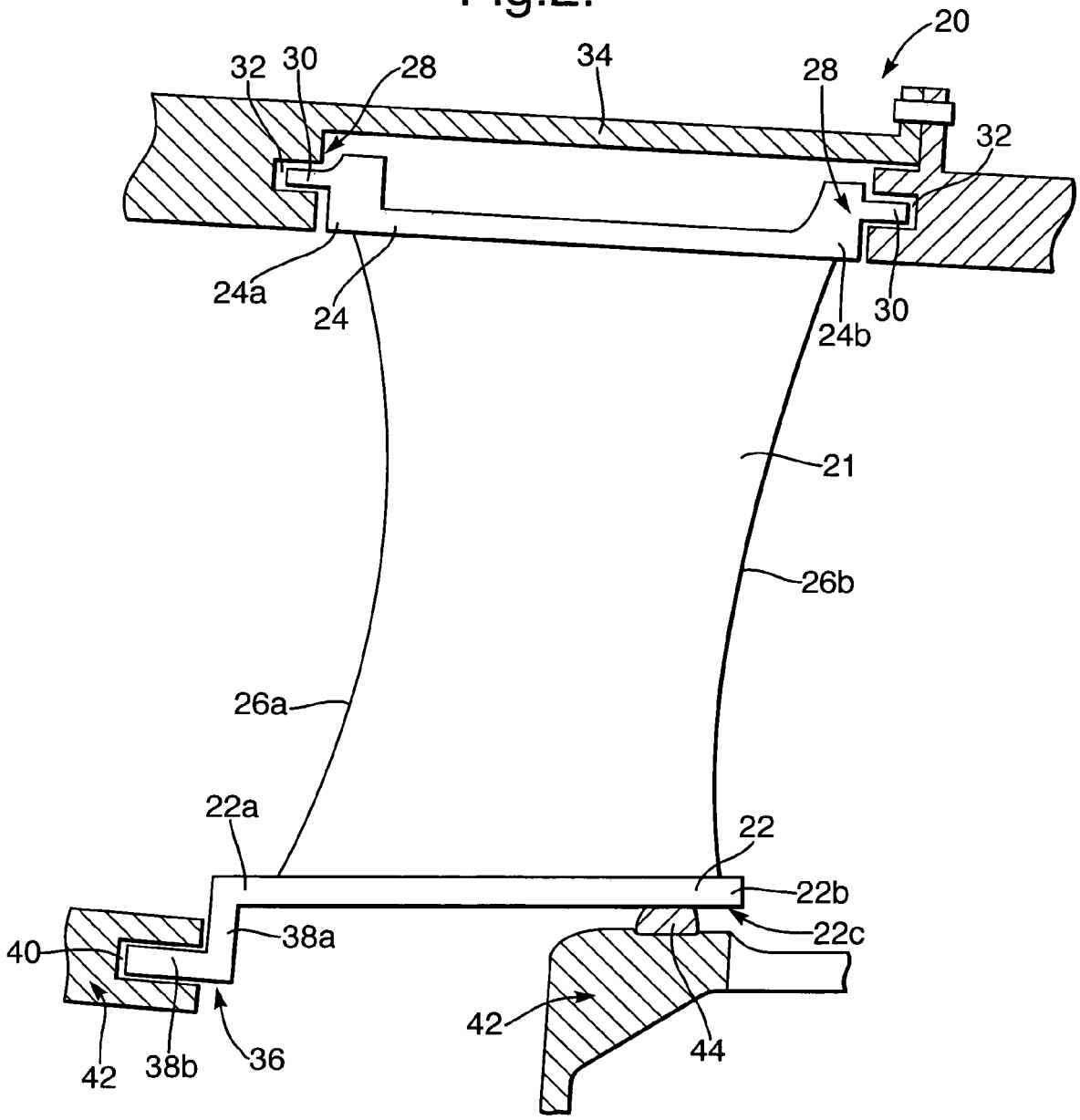
FIG. 2 is a cross-sectional view of a guide vane arrangement according to the present invention.

Referring to FIG. 2, each vane member 21 is in the form of an aerofoil and extends between radially inner and outer platforms 22, 24. Each vane member 21 has leading and trailing edges 26*a*, 26*b*. The inner and outer platforms 22, 24 each have an upstream edge 22*a*, 24*a* located adjacent the leading edge 26*a* of the vane member 21, and a downstream edge 22*b*, 24*b* located adjacent the trailing edge 26*b* of the vane member 21.

The outer platform 24 includes outer platform mounting means 28 which are arranged to rigidly mount the outer platform 24 at its upstream and downstream edges 24*a*, 24*b* on an outer mounting member 34, such as an outer compressor casing of the gas turbine engine 10. In the illustrated arrangement, the outer platform mounting means 28 comprises two flanges 30, projecting outwardly from the upstream and downstream edges 24*a*, 24*b* of the outer platform 24, which are locatable in correspondingly shaped recesses 32 in the outer mounting member 34. It will of course be understood that other ways of mounting the outer platform 24 on the outer mounting member 34 could be employed and are within the scope of the present invention.

The inner platform 22 includes inner platform mounting means, designated generally by the reference numeral 36, at an upstream edge 22*a* thereof which are arranged to rigidly mount the inner platform 22 at its upstream edge 22*a* on an inner mounting member 42.

In the illustrated embodiment, the inner platform securing means 36 is defined by the inner platform 22, and comprises a radially inwardly extending portion 38*a* and a forwardly extending portion 38*b* which extends in an upstream direction of the engine 10. The forwardly extending portion 38*b* locates in a recess 40 defined by the inner mounting member 42, for example a shroud ring, of the gas turbine engine 10. It will of course be understood that other ways of mounting the inner platform 22 on the inner mounting member 42 could be employed and are within the scope of the present invention.

According to embodiments of the invention, the inner mounting member 42 includes resilient means 44 which abuts the inner platform 22 near to its downstream edge 22*b*. This provides a further mounting point for the vane member 21 and permits relative movement between the inner platform 22 (and hence the vane member 21) and the inner mounting member 42. As can be seen in FIG. 2, the resilient means 44 abuts an underside 22*c* of the inner platform 22.

The resilient means 44 is resiliently deformable to permit relative movement in the radial direction of the engine 10 between the inner platform 22 (and hence the vane member 21) and the inner mounting member 42. The resilient means 44 desirably comprises a viscoelastic material such as rubber or rubber-like material. In alternative embodiments of the invention, the resilient means 44 may comprise viscous fluid contained within a flexible housing to define a fluid-filled balloon.

In the illustrated embodiment, due to the fact that the inner platform 22 is rigidly mounted on the inner mounting member 42 at its upstream edge 22*a* and in abutment with the resilient means 44 at its downstream edge 22*b*, the inner platform 22 is movable, to accommodate radial expansion of the vane member 21, generally pivotally about the upstream edge 22*a*. Thus, when there is thermal expansion of the vane member 26 in the radial direction, the co-operation of the inner platform 22 with the resilient means 44 ensures that the vane member 21 is not significantly compressed and, therefore, unduly stressed which could be the case if the inner platform 22 was rigidly mounted on the inner mounting member 42 of the engine 10 at both its upstream and downstream edges 22*a*, 22*b*. In the illustrated embodiment, maximum radial expansion of the vane member 21 is permitted in the region of the trailing edge 26*b*.

Thermal expansion can be a particular problem with vane members 21 which are fabricated from composite materials, and the present invention therefore particularly relates to guide vane arrangements 20 in which at least the vane member 21 comprises a composite material. It is not however limited to vane arrangements 20 comprising composite materials.

In embodiments of the present invention, the vibrational modes and frequencies of the guide vane arrangement 20 are similar to arrangements in which the inner and outer platforms 22, 24 are both rigidly mounted on the inner and outer mounting members 42, 34 at their respective upstream and downstream edges. The vibrationally induced stresses are however reduced when the guide vane arrangement 20 according to the invention is employed due to the damping provided by the resilient means 44. The fatigue life of the arrangement 20 is thus increased. The static stresses are also reduced as the vane member 21 is less severely constrained and this will have a benefit to both low cycle fatigue (LCF) life and high cycle fatigue (HCF) life.

The provision of the resilient means 44 and the abutment thereof with the underside 22*c* of the inner platform 22 also prevents a recirculating air flow under the inner platform 22, which would otherwise occur in the absence of the resilient means 44 and thereby reduce the efficiency of the engine 10.

Although embodiments of the invention have been described in the preceding paragraphs with reference to various examples, it should be appreciated that various modifications to the examples given may be made without departing from the scope of the present invention, as claimed.

For example, the outer platform 24 may be mounted on the outer mounting member 34 of the engine 10 using any suitable mounting configuration. The vane member 26 may be fabricated from any suitable material.

The resilient means 44 could be located on the inner mounting member 42 so that it abuts the inner platform 22 near to its upstream edge 22*a*, the inner platform 22 being rigidly mounted on the inner mounting member 42 at its downstream edge 22*b*.

Alternatively or additionally, the resilient means 44 may be provided on the outer mounting member 30 for abutment with the outer platform 24. The resilient means 44 could be located on the outer mounting member 34 so that it abuts the outer platform 24 near to its downstream edge 24*b*, the outer platform 24 being rigidly mounted on the outer mounting member 34 at its upstream edge 24*a*. Alternatively, the resilient means 44 could be located on the outer mounting member 34 so that it abuts the outer platform 24 near to its upstream edge 24*a*, the outer platform 24 being rigidly mounted on the outer mounting member 34 at its downstream edge 24*b*. In such alternative arrangements, the inner platform 22 may be rigidly mounted on the inner mounting member 42 at its upstream and downstream edges 22*a*, 22*b*.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A guide vane arrangement for a gas turbine engine, the guide vane arrangement comprising:

a vane member extending between inner and outer platforms, wherein said inner and outer platforms each having associated upstream and downstream edges; and inner and outer mounting members on which each of the inner and outer platforms is respectively mounted, one of the inner and outer mounting members including a resilient means for abutment with the respective inner or outer platform to permit relative radial movement between the inner or outer platform and the respective inner or outer mounting member, wherein one of the platforms abuts the resilient means at a position close to one of its edges and is rigidly mounted at its other edge.

2. A guide vane arrangement according to claim 1, wherein the inner platform abuts the resilient means.

3. A guide vane arrangement according to claim 1, wherein the inner platform abuts the resilient means at a position close to its downstream edge and is rigidly mounted on the inner mounting member at its upstream edge.

4. A guide vane arrangement according to claim 1, wherein the inner platform abuts the resilient means at a position close to its upstream edge and is rigidly mounted on the inner mounting member at its downstream edge.

5. A guide vane arrangement according to claim 1, wherein the inner platform includes inner platform mounting means for rigidly mounting it on the inner mounting member at its upstream or downstream edge.

6. A guide vane arrangement according to claim 1, wherein the outer platform is rigidly mounted on the outer mounting member at its upstream and downstream edges.

7. A guide vane arrangement according to claim 6, wherein the outer platform includes outer platform mounting means for rigidly mounting it on the outer mounting member at its upstream and downstream edges.

8. A guide vane arrangement according to claim 1, wherein the outer platform abuts the resilient means.

9. A guide vane arrangement according to claim 1, wherein the outer platform abuts the resilient means at a position close to its downstream edge and is rigidly mounted on the outer mounting member at its upstream edge.

10. A guide vane arrangement according to claim 1, wherein the outer platform abuts the resilient means at a position close to its upstream edge and is rigidly mounted on the outer mounting member at its downstream edge.

11. A guide vane arrangement according to claim 1, wherein the outer platform includes outer platform mounting means for rigidly mounting it on the outer mounting member at its upstream or downstream edge.

12. A guide vane arrangement according to claim 1, wherein the inner platform is rigidly mounted on the inner mounting member at its upstream and downstream edges.

13. A guide vane arrangement according to claim 12, wherein the inner platform includes inner platform mounting means for rigidly mounting it on the inner mounting member at its upstream and downstream edges.

14. A guide vane arrangement according to claim 1, wherein the resilient means comprises a viscoelastic material.

15. A guide vane arrangement according to claim 1, wherein the resilient means comprises a rubber material.

16. A guide vane arrangement according to claim 1, wherein the resilient means comprises viscous fluid contained within a flexible housing.

17. A guide vane arrangement according to claim 1, wherein the vane member comprises a composite material.

18. A gas turbine engine including a guide vane arrangement according to claim 1.

* * * * *